US006438865B1

(12) United States Patent
Bradley

(10) Patent No.: US 6,438,865 B1
(45) Date of Patent: Aug. 27, 2002

(54) CLOTHES DRYER VENT GUILLOTINE/ISOLATOR

(76) Inventor: Frank R. Bradley, 3060 N. Atlantic Ave. #109, Cocoa Beach, FL (US) 32931

( * ) Notice: Subject to any disclaimer, the term of this patent is extended or adjusted under 35 U.S.C. 154(b) by 0 days.

(21) Appl. No.: 09/670,038

(22) Filed: Sep. 26, 2000

(51) Int. Cl.[7] ..... F26B 19/00; F26B 25/06

(52) U.S. Cl. ..... 034/235

(58) Field of Search ..... 34/80, 235, 82, 34/86, 359, 210, 218; 126/84, 312, 293, 316

(56) References Cited

U.S. PATENT DOCUMENTS 3,589,269 A * 6/1971 Weir, Sr. ..... 99/332
4,225,080 A * 9/1980 Barth ..... 236/1 G
4,235,219 A * 11/1980 DeFoe ..... 126/504
4,289,271 A * 9/1981 Barth ..... 236/1
4,327,893 A * 5/1982 Bachmann et al. ..... 251/159
4,415,139 A * 11/1983 Potts ..... 251/62
5,352,206 A * 10/1994 Cushieri et al. ..... 604/164
5,566,667 A * 10/1996 Cox ..... 126/507
5,603,168 A * 2/1997 McMahon, Jr. ..... 34/471
6,052,837 A * 4/2000 Norton et al. ..... 4/217

* cited by examiner

*Primary Examiner*—Teresa Walberg
*Assistant Examiner*—Daniel Robinson
(74) *Attorney, Agent, or Firm*—Brian S. Steinberger; Law Offices of Brian S. Steinberger, P.A.

(57) ABSTRACT

A device for isolating dryer exhaust lines. The device can be attached between a dryer exhaust and an exterior dryer vent. The device has a door that slides between an upper position allowing the air passage duct between the dryer exhaust and the exterior vent to be open and a closed position which closes the air passage duct. A rod slidable within eye type slits has a handle at one end and is attached to the sliding door at the opposite end. A user can push the rod downward which slides the door to close the air passage duct. Lifting the handle pulls the rod up which causes the door to slide up opening the air passage duct. An electrical safety disconnect switch can disconnect power to the dryer when the door is in a closed position. The safety switch can be turned off allowing the dryer to be powered when the door is in the open position. A whistle can further operate in the device which can turn on when pressure builds up if the dryer is turned on and the door is still in the closed position. The device can be used in multifamily, multistory, and other applications where a common exhaust duct is used to service more than one dryer. The device can prevent odors, smells, heat, condensation that is caused from a neighbors dryer to pass into adjacent dryers that share the same common exhaust duct.

14 Claims, 6 Drawing Sheets

CLOTHES DRYER VENT GUILLOTINE/ISOLATOR

This invention relates to dryers, and in particular to a method and apparatus for opening and closing an exhaust vent on the a dryer.

BACKGROUND AND PRIOR ART

It is typical for clothes dryers to have exhaust vents that exhaust heated air from the dryer. However, these typical exterior feeding vents have been known to have problems. For example, bugs and rodents have been known to crawl into the exterior vents and nest in the ducts between the dryer and the exterior vent. Besides being a medium that allows for these creatures to crawl into the home, the insects and rodents can further clog the ducts leading to the exhaust vents and cause a dangerous condition by preventing heated air to exhaust outside.

Additional problems exist in buildings where a common exhaust duct connects to different dryers such as those on different floors, and the like. The heated air from one running dryer can pass into the common duct and pass into a second apartment by the exhaust line of the dryer in the second apartment. Thus, the occupants of a second apartment can feel the heat generated from a neighbors dryer in their home. Similarly, if smells and odors are created from the drying operation in one apartment's dryer, the common ducts can further pass those smells and odors into other apartments. Also, the common duct allows insects and rodents to travel from apartment to apartment by way of the common dryer duct. Furthermore, the heat generated from on neighbors dryer can promote condensation from moisture buildup in the exhaust lines and even in the adjacent dryers connected by the common duct. The moisture buildup can lead to rust and corrosion of neighboring apartment vents and the dryers themselves causing further damage thereof.

Various devices have been proposed over the years for use with clothes dryers. See for example, U.S. Pat. No. 3,176,925 to Hartung; U.S. Pat. No. 4,152,844 to Materniak et al.; U.S. Pat. No. 4,395,831 to Nielsen; U.S. Pat. No. 4,530,170 to Green; U.S. Pat. No. 5,257,468 to Leburn; U.S. Pat. No. 5,482,507 to Priet; and U.S. Pat. No. 5,722,181 to Meyer. However, none of the devices solves all of the problems described above.

SUMMARY OF THE INVENTION

The first objective of the invention is to provide a device for preventing insects and rodents from crawling into a dryer exhaust vent.

The second objective of the invention is to provide a device for eliminating odors and smells from passing from one dryer to another dryer through a common exhaust duct.

The third objective of the invention is to provide a device for preventing heat from passing from one dryer to another through a common exhaust duct.

The fourth objective of the invention is to provide a device for eliminating moisture from building up in a dryer having a common exhaust duct with other dryers.

A preferred embodiment of the exhaust isolator device for dryers includes a dryer having an exhaust line that is connected to an exterior vent and a door that can slide into and out of the exhaust line for opening and closing air passing between the exhaust line and the exterior vent. A handle attached to one end of a rod with the second end of the rod attached to the door can move the door into and out of the exhaust line. The rod can be mounted to slide within eyelets, and the like. The device can have various safety features that assure that the dryer will not be operated when the door is in a closed position. An audible emitter can be a whistle that both emits an audible signal if the door is closed and further acts as a safety valve to release air pressure builds up between the dryer and the door. Another safety feature can be a safety override switch such as an electrical type toggle switch, and the like, for preventing the dryer from being turned on when the door is in the closed position. A still another safety feature can be a visual indicator such as a green coloring, a light, combinations thereof and the like, can also be used to indicate when the door is in a closed position.

The invention has applicability for single home use when the dryer vents to an outside wall. Additionally, the invention can be used in multifamily environments such as but not limited to an apartment complex and the like, where a common duct connects individual clothes dryer exhaust vents to a single exterior exhaust point. Installing the invention device on each dryer can prevent heated air, odors, and moisture from passing between the various dryers interconnected by the common duct.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
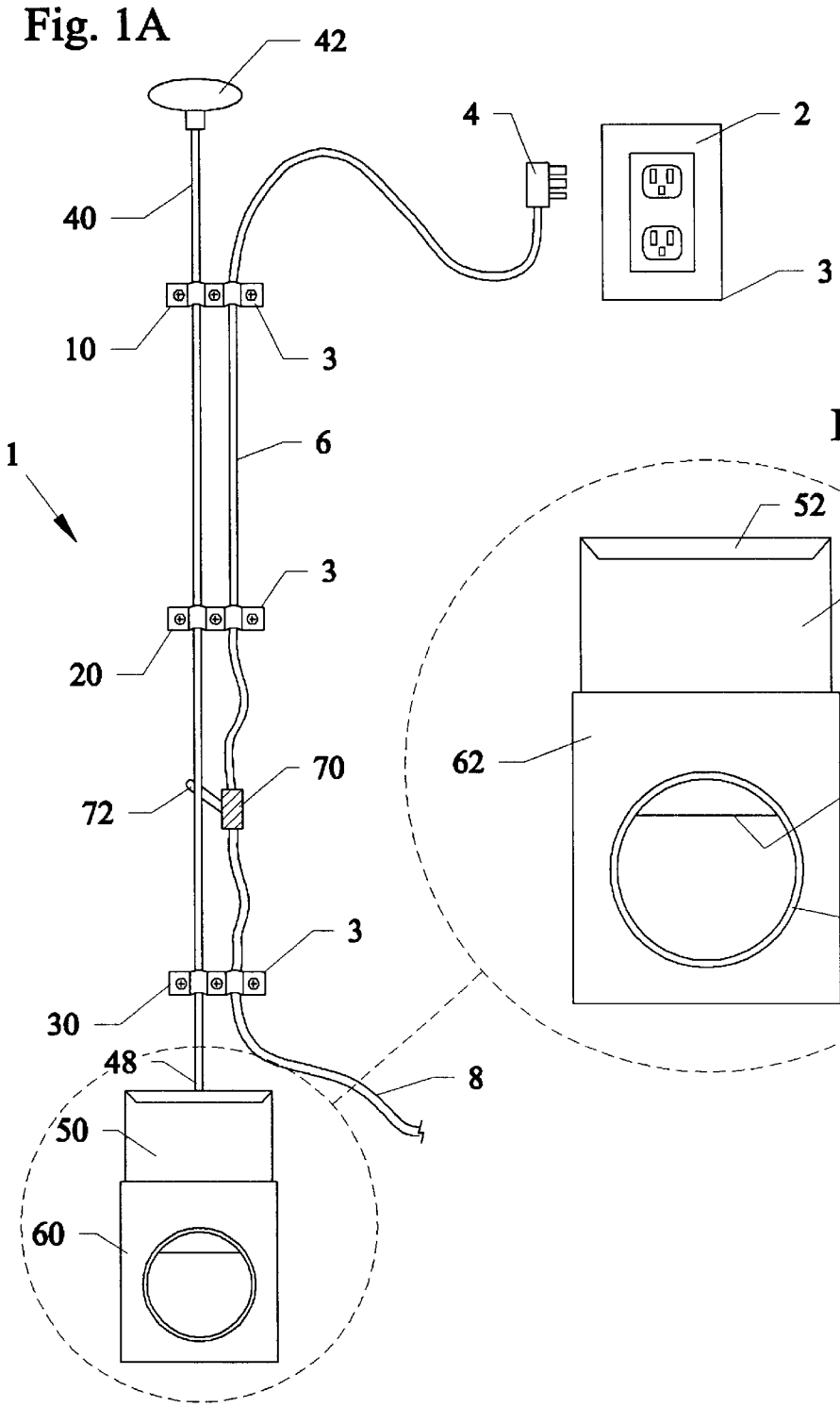
FIG. 1A is a front view of an exhaust shut off slidable vent door housing and wall mounting assembly with safety disconnect override switch.
Figure 1B:
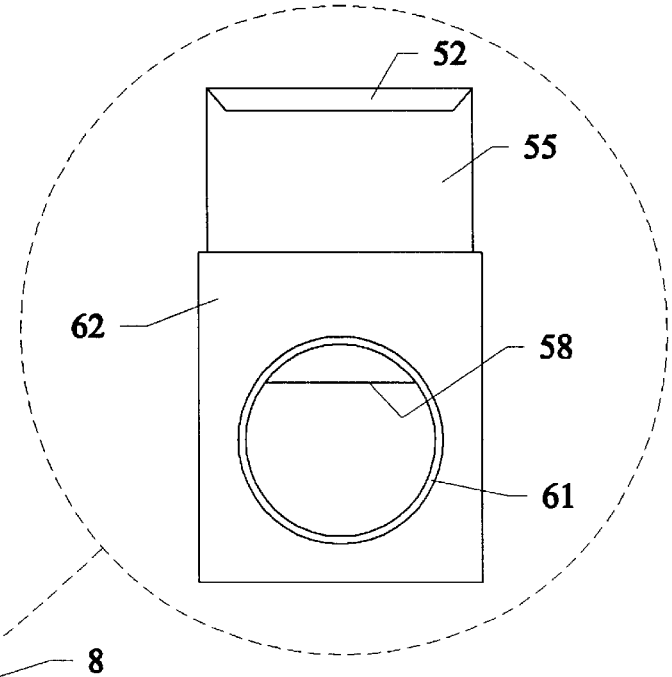
FIG. 1B is an enlarged view of the exhaust shut off vent door housing of FIG. 1A.
Figure 2A:
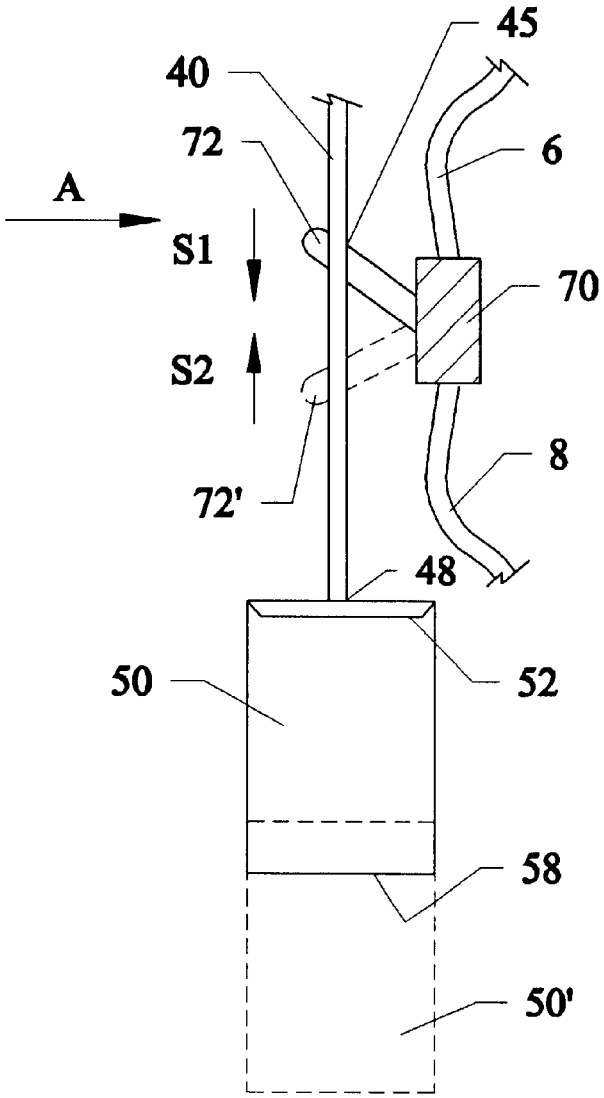
FIG. 2A is an isolated view of the safety disconnect override switch and slidable rod of FIG. 1A.
Figure 2B:
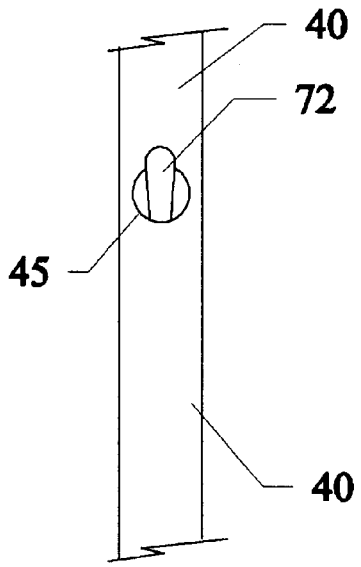
FIG. 2B is a side view of the safety disconnect switch of FIG. 2A along arrow A.

FIG. 1A is a front view of the invention that includes an exhaust shut off slidable vent door 50 and housing 60 and wall mounting assembly 10–40 with safety disconnect override switch 70. FIG. 1B is an enlarged view of the exhaust shut off vent door 50 and housing 60 of FIG. 1A. FIG. 2A is an isolated view of the safety disconnect override switch 70 and slidable rod 40 of FIG. 1A. FIG. 2B is a side view of the safety disconnect switch 70 of FIG. 2A along arrow A. Referring to FIGS. 1A–2B, a rectangular housing has a front face 62 and rear face 64 each with an opening therethrough 61, 63 (rear face 64 and rear opening are more clearly seen in FIG. 3C), and a slidable planar guillotine type door 50 having an upper lid tip 52, and a lower end 58 that slides between an open position allowing air to pass between openings 61, 63 to a closed position which prevents air passing between openings 61, 63. The slidable door 50 is actuated by a slidable rod 40 having a lower end 48 attached to the top of the door 50, and an upper end 42 that can have a handle thereon. The handle 42 allows a user to move rod upward in the direction of arrow S1 which opens door 50 and alternatively downward in the direction of arrow S2 which closes door 50. Eyelits 10, 20, 30 can each be attached to a rear wall 3 which can also have a power outlet 2.

Figure 3A:
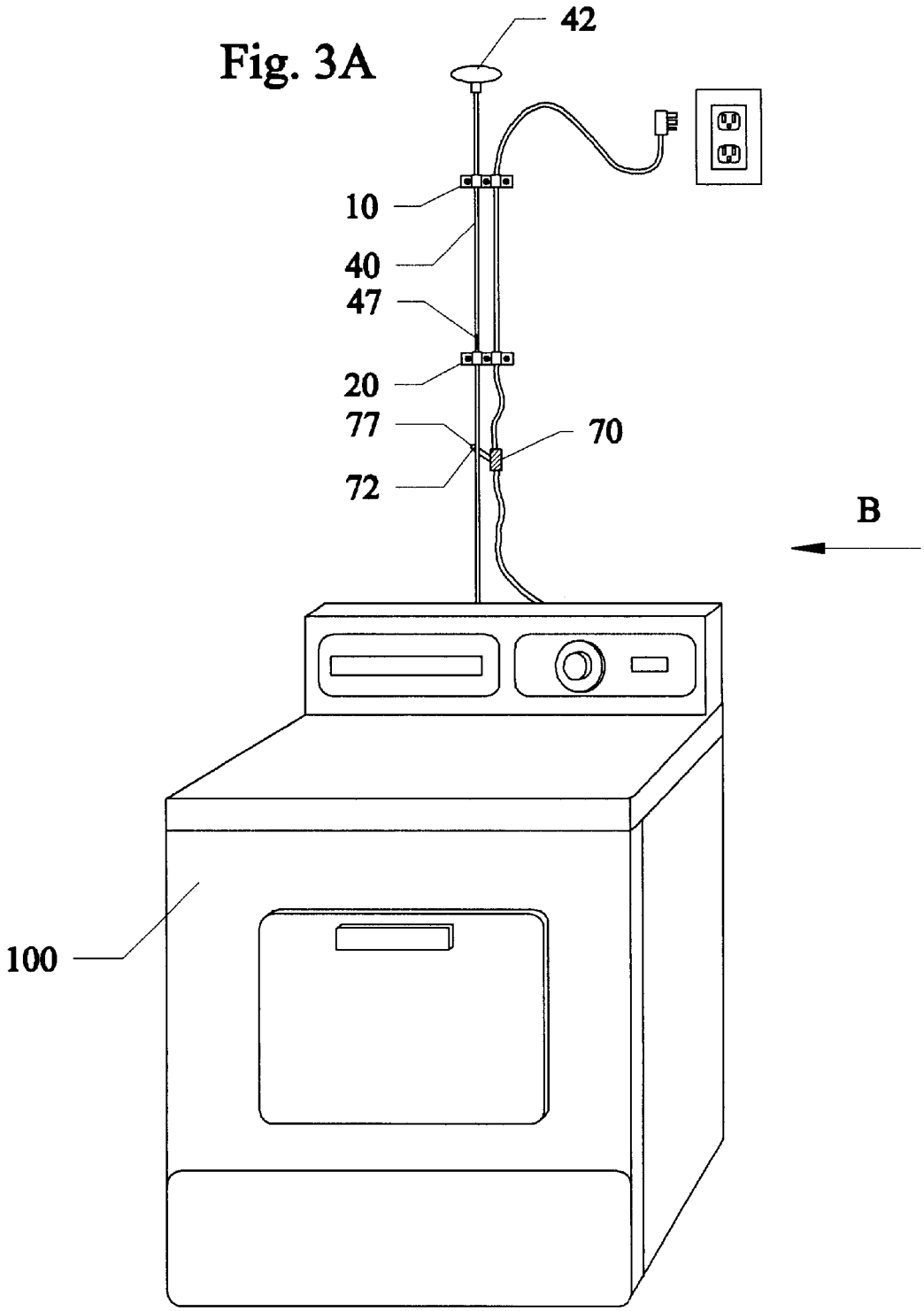
FIG. 3A is another front view of FIG. 1A connected to a clothes dryer.
Figure 3B:
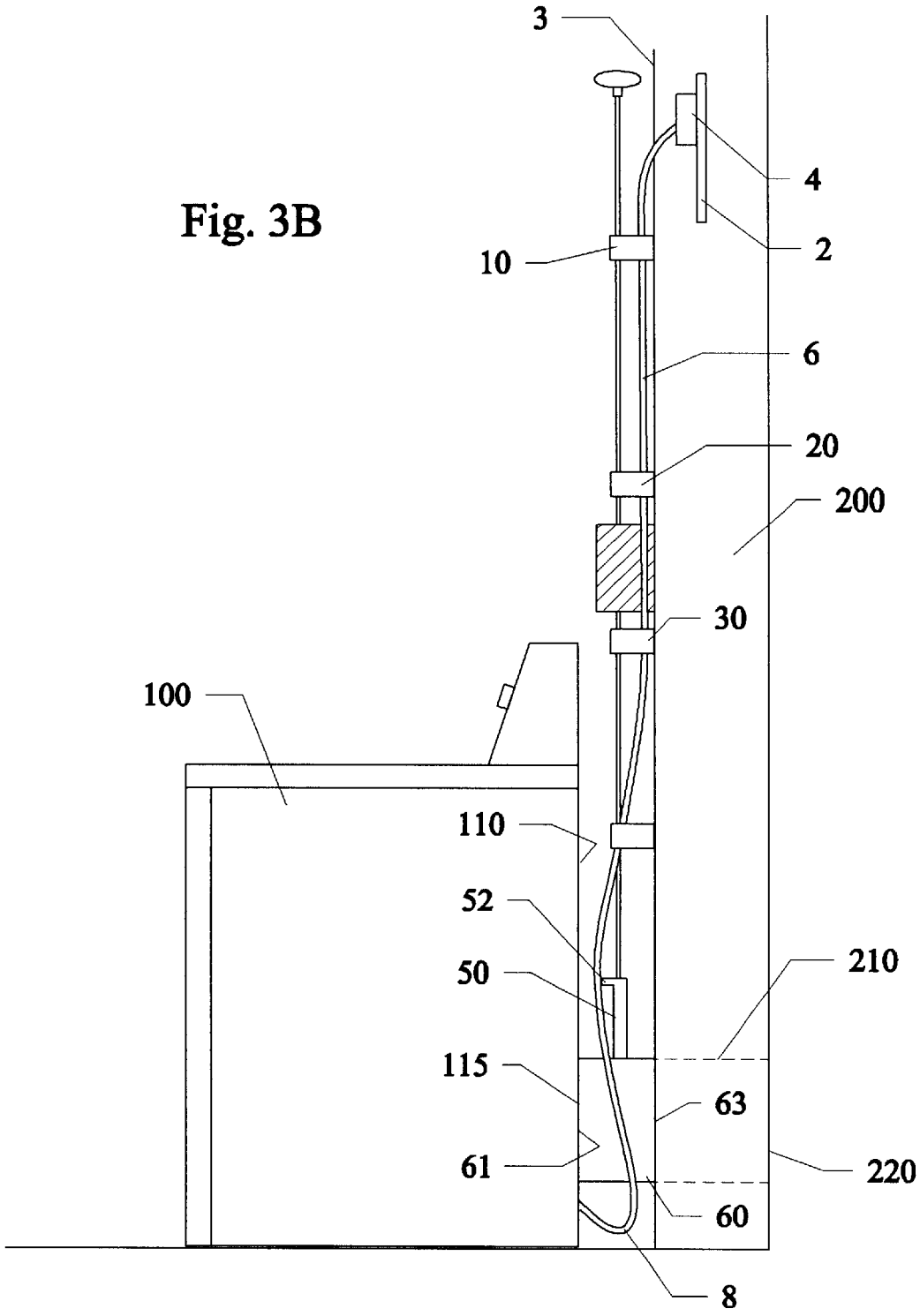
FIG. 3B is a side view of FIG. 3A along arrow B showing the slidable vent door housing connected between the dryer exhaust and an exterior vent.
Figure 3C:
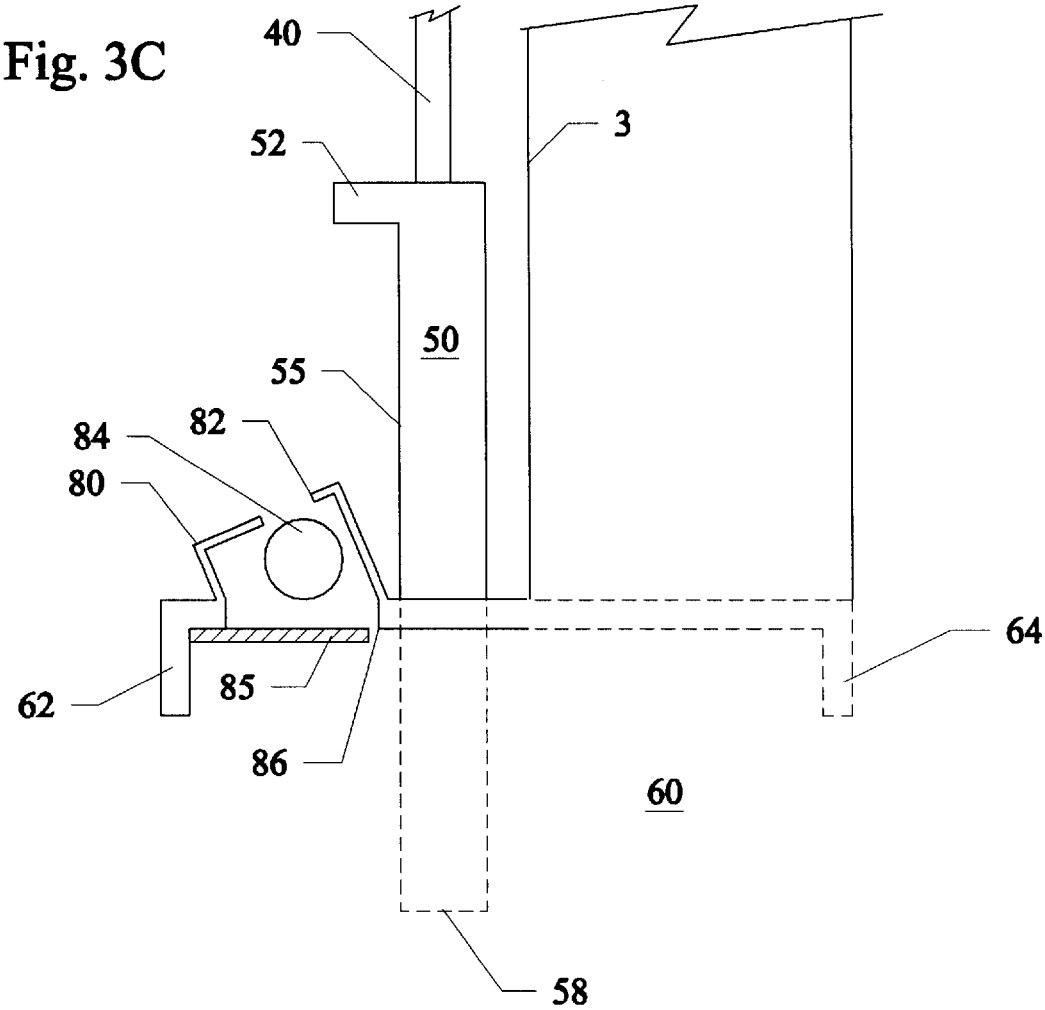
FIG. 3C is an enlarged sectional view of the slidable vent door housing of FIG. 3B.
Figure 3C:
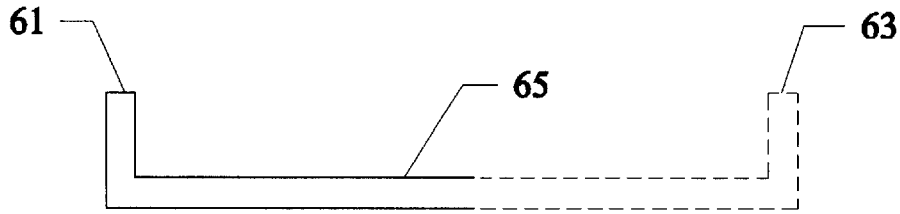

FIG. 3A is another front view of the invention 1 of FIG. 1A connected to a clothes dryer 100. The dryer 100 can be a clothes dryer such as but not limited to an air heatable and/or coolable dryer. The dryer 100 can be an electric powered dryer, a gas powered dryer, and the like. FIG. 3B is a side view of FIG. 3A along arrow B showing the slidable vent door housing 60 connected between the dryer exhaust 115 on the back 110 of the dryer 100 and an exterior vent 220 outside a wall 200. FIG. 3C is an enlarged sectional view of the slidable vent door housing 60 of FIG. 3B.

Referring to FIGS. 1A–3C, the dryer 100 can for example be electric powered and have a power cord 8 that has portions 4 that passes through wall mounted eyelets 10, 20, 30 and a plug 4 which is plugged into wall power outlet socket 2. A safety override switch 70 such as an electrical toggle switch can also be mounted to the wall 3, and have a switch portion 52 which moves between an on position 72 and an off position 72'. The switch portion can pass through an aperture 45 formed through rod 40 so that moving the rod downward in the direction of arrow S1 causes the switch portion 72 to move from an on position to an off position 72' which prevents power from reaching dryer 100. Thus, when door 50 is in a closed position where face portion 55 is between openings 61, 63 of the vent housing 60, the dryer cannot be turned on and preventing heated pressurized air from building up. Moving the rod upward in the direction of arrow S1 flips switch 70 on allowing power to reach dryer 100.

Referring to 3C, an audible indicator valve 80 can be used which is also useful as a safety feature. The valve 80 can be a whistle having a lower flexible flap 85 (such as a rubber flap which is inside of housing 60, where the flap covers lower opening 86 of the whistle 80. A ball 84 is moveable inside the hollow valve housing, and a smaller top opening 82 allows air to escape outside housing 60 when door 50 is in a closed position. If the dryer 100 is activated while the bottom edge 58 of door 50 is adjacent the bottom floor 65 of housing 60 air pressure will push flap 85 upward allowing air to escape housing 60 by way of valve openings 86, 82 and causing an audible whistle signal which would indicate to user of the dryer 100 to turn off the machine.

Referring to FIG. 3A, a portion 47 of rod 40 can be colored green so that when that portion is moved above eyelet 20 to be exposed, the green color would indicate a safe condition for operating the dryer 100. Another visual indicator can be part of power switch 70, where portion 77 can include a light source that turns on to emit a light such as green when the power switch 70 is in an on state and red when the power switch 70 is in an off state 72'.

Figure 4:
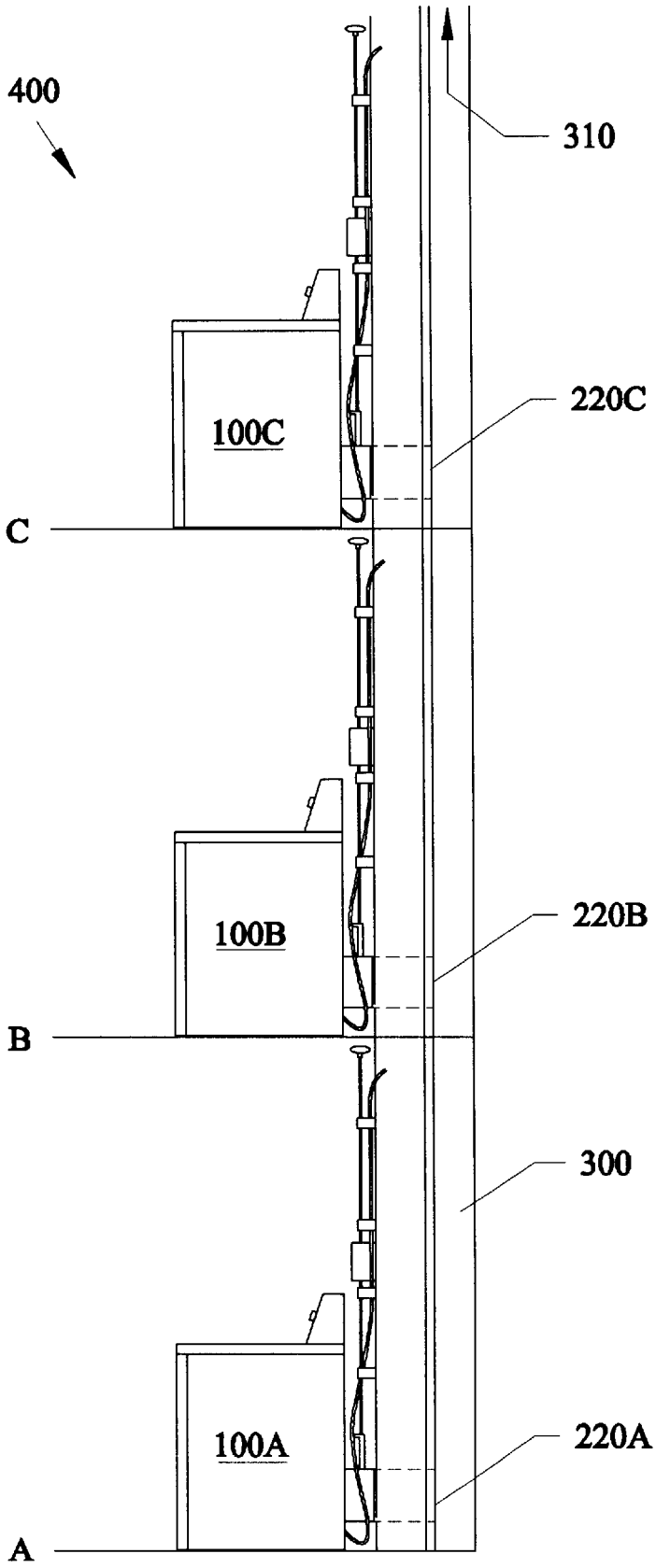
FIG. 4 is a side view of the invention of the preceding figures used in a multilevel, multifamily application.

FIG. 4 is a side view of the invention of the preceding figures used in a multilevel, multifamily application 400, where dryers 100A, 100B, 100C can be located on different floors A, B, C and their exhaust vents 220A, 220B, 22C each feed into a common main building duct 300 that exhausts to a single exterior location 310. The invention 1 previously described can be applied individually to each of the dryers 100A, 100B, 100C so that heat, odors, moisture and like, that emanates from one dryer does not enter into an effect any of the other dryers.

The invention can be used with other techniques for putting the dryer user on notice that the door is in a closed position. For example, a powered green light can be connected to the dryer power line to indicate the door being in the open position. Additionally, a red light can be used to indicate the door is in a closed position. Additionally, a portion of the rod can be painted green so that when the door is in an open position green portion of the rod is exposed, and when the door is in a closed position, only a red portion of the rod is exposed. Fluorescent colors can be further used to enhance the visibility of the colors.

Although the preferred embodiment describes mounting the sliding rod on a rear wall, the rod can be mounted on the side of the dryer so that the hand is closer to the dryer operator controls, and/or is closer to the front service door for the dryer.

While the preferred embodiment describes a rod attached to the sliding door, the invention can be used with just a handle portion on the top of the door.

Although the preferred embodiment describes the rod being positioned vertically above the sliding door, the rod can be positioned in a different orientation such as a horizontal position, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exhaust isolator device comprising in combination:

a dryer having a top portion, a bottom portion and a rear portion having an exhaust line extending out from behind the dryer that is connected to an exterior existing dryer vent, the vent being located behind and below the top portion of the dryer;

a door which is that can slidable into and out of the exhaust line for opening and closing air passing between the exhaust line and the exterior vent; and a moveable handle mounted above the top portion of the dryer for moving the door into positions for opening and the closing positions for allowing and restricting air passing therethrough; and a vertical longitudinal member for attaching the handle to the slidable door.

2. The exhaust isolator device of claim 1, wherein the vertical longitudinal member includes:

a rod having one end attached to the door and a second end attached to the handle.

3. The exhaust isolator of claim 2, further comprising:

means for slidably mounting the rod.

4. The exhaust isolator of claim 3, wherein the slidable means include: an eyelet.

5. The exhaust isolator of claim 1, further comprising:

a safety means that engages when the door is in a closed position.

6. The exhaust isolator of claim 5, wherein the safety means includes:

an audible emission that is activated when the door is in the closed position.

7. The exhaust isolator of claim 6, wherein the audible emission is emitted from:

a whistle that is connected between the dryer and the door, the whistle operates as a release valve when the door is in the closed position and air pressure builds up between the dryer and the door.

8. The exhaust isolator of claim 5, wherein the safety means includes:

safety override switch for preventing the dryer from being turned on when the door is in the closed position.

9. The exhaust isolator of claim 8, wherein the safety override switch includes:

an electrical switch which deactivates power to the dryer when the slidable door is closed.

10. The exhaust isolator of claim 5, wherein the safety means includes:

a visual indicator that is activated when the door is in the closed position.

11. The exhaust isolator of claim 10, wherein the visual indicator is a green color.

12. The exhaust isolator of claim 1, further comprising:

a second dryer having a second exhaust line that is connected to a second exterior vent, the second dryer being located above the first dryer on a different floor from the first dryer;

a second door that can slide into and out of the second exhaust line for opening and closing air passing between the second exhaust line and the second exterior vent; and a vertical main duct that connects the first exhaust line to the second exhaust line, wherein the first door and the second door prevent heated air, odors, and moisture from passing between the first dryer and the second dryer.

13. An exhaust isolator system for dryers in buildings, comprising in combination:

a building having more than floor;

a first dryer having a first exhaust being located on a first floor in the building;

a second dryer having a second exhaust being located on a second floor in the building above the first floor;

a common vertical exhaust duct for connecting the first exhaust and the second exhaust to an exterior vent; and slidable means behind each of the first dryer and the second dryer for preventing air formed from each of the first dryer and the second dryer from passing to one another through their respective exhausts.

14. The exhaust isolator of claim 13, wherein the slidable preventing means includes:

closeable doors for each of the first dryer and the second dryer.

* * * * *